US006750611B2

(12) United States Patent
Gubbels

(10) Patent No.: US 6,750,611 B2
(45) Date of Patent: Jun. 15, 2004

(54) HIGH-PRESSURE DISCHARGE LAMP HAVING A CERAMIC DISCHARGE VESSEL WITH A CERMET LEAD-THROUGH

(75) Inventor: Henricus Peter Maria Gubbels, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 88 days.

(21) Appl. No.: 10/043,391

(22) Filed: Oct. 26, 2001

(65) Prior Publication Data

US 2002/0105273 A1 Aug. 8, 2002

(30) Foreign Application Priority Data

Nov. 6, 2000 (EP) ..... 00203867

(51) Int. Cl.[7] ..... H01J 17/18; H01J 61/36
(52) U.S. Cl. ..... 313/623; 313/625
(58) Field of Search ..... 313/623–625, 313/567, 331

(56) References Cited

U.S. PATENT DOCUMENTS 4,354,964 A * 10/1982 Hing et al. ..... 252/512
4,800,320 A * 1/1989 Kajihara et al. ..... 313/625
4,808,882 A * 2/1989 Parker et al. ..... 313/625
4,825,126 A * 4/1989 Izumiya et al. ..... 313/623
4,959,588 A * 9/1990 Vida et al. ..... 313/625
5,075,587 A * 12/1991 Pabst et al. ..... 313/25
5,271,758 A * 12/1993 Buljan et al. ..... 75/232
5,352,952 A * 10/1994 Juengst ..... 313/623
5,532,552 A * 7/1996 Heider et al. ..... 313/623
5,861,714 A * 1/1999 Wei et al. ..... 313/625
6,147,453 A * 11/2000 Geijtenbeek et al. ..... 313/640
6,528,945 B2 * 3/2003 Kelly et al. ..... 313/623

FOREIGN PATENT DOCUMENTS

EP 0887839 A2 12/1998 ..... H01J/61/82
JP 05334997 A * 12/1993 ..... H01J/61/36
WO 96/28839 9/1996

* cited by examiner

*Primary Examiner*—Nimeshkumar D. Patel
*Assistant Examiner*—Anthony Perry
(74) *Attorney, Agent, or Firm*—Ernestine C. Bartlett

(57) ABSTRACT

The invention relates to a high-pressure discharge lamp having a discharge vessel with a ceramic wall which is closed at an end by a projecting plug. A lead-through construction inside the projecting plug leads to an electrode inside the discharge vessel. Part of the lead-through construction is formed by a cermet, which extends fully inside the lead-through element.

According to the invention, the cermet is directly fastened to the projecting plug by means of a sintered joint.

8 Claims, 1 Drawing Sheet

HIGH-PRESSURE DISCHARGE LAMP HAVING A CERAMIC DISCHARGE VESSEL WITH A CERMET LEAD-THROUGH

BACKGROUND OF THE INVENTION

The invention relates to a high-pressure discharge lamp provided with a discharge vessel with a ceramic wall which is closed at an end by a projecting plug through which a lead-through construction extends from an end of the projecting plug to an electrode arranged in the discharge vessel, part of said lead-through construction being a cermet.

A lamp of the kind mentioned in the opening paragraph is known from WO 96/28839. The known lamp is a metal halide lamp. Such lamps are widely used in practice and have a high luminous efficacy combined with favorable color properties. The discharge vessel of the lamp contains one or several metal halides in addition to Hg. The lead-through construction in the known lamp achieves a gastight connection to the projecting plug by means of a melting glass fusion joint. The gastight connection is realized to a major extent between the end of the projecting plug and an electrical conductor connected to the cermet and extending from the end to the exterior. Nb is used as a conductor in the area of the gastight melting glass fusion joint in practice because this has a coefficient of expansion which differs only very slightly from that of the ceramic wall of the projecting plug. A further advantage of Nb is its ductility property. Nb, however, is not resistant to halides. To counteract attacks on the Nb, the melting glass fusion joint extends along part of the cermet in the known lead-through construction. To obtain a continuation length of the melting glass fusion joint along the cermet which was found to be desirable, the projecting plug is made impermeable to light over part of its outer side. It is achieved thereby that the electrical conductor extending from the cermet into the projecting plug is not in direct contact with filling ingredients inside the discharge vessel.

A ceramic wall in the present description and claims is understood to be a wall made from one of the following materials: monocrystalline metal oxide (for example sapphire), densely sintered polycrystalline metal oxide (for example $Al_2O_3$, YAG), and densely sintered polycrystalline metal nitride (for example AlN).

It was found to be a disadvantage of the known lamp that the melting glass fusion joint itself appears to be vulnerable to attacks by filling ingredients from the discharge vessel during lamp life. This gives rise to leaks in the course of time, which results in the end of lamp life.

OBJECTS AND SUMMARY OF THE INVENTION

The invention has for its object to provide a means for counteracting the above disadvantage. According to the invention, a lamp of the kind mentioned in the opening paragraph is for this purpose characterized in that the cermet is directly fastened to the projecting plug by means of a sintered joint.

It is an advantage of the lamp according to the invention that the use of melting glass can be dispensed with. It is indeed possible to form the sintered joint between the projecting plug and the cermet into a hermetically closed seal by means of a suitable sintering process which is known per se. A further advantage is that the projecting plug need not be made impermeable to light over part of its outer surface. This means a simplification in lamp manufacture, which is a considerable improvement in mass production on an industrial scale. Moreover, the electrical conductor no longer forms a necessary part of the lead-through construction, which offers a greater freedom of choice as regards the materials of this conductor.

In an advantageous embodiment of the lamp according to the invention, the projecting plug extends over a length L, and the sintered joint has a length of at most 0.8L. The inventors have found that the risk of cracks and fractures occurring in the projecting plug is very strongly reduced in this manner. This relates in particular to the risk of the formation of cracks and fractures owing to thermal stresses during the sintering process. A further improvement can be realized here if the sintered joint extends into the projecting plug in a direction from the end to a distance away from the end of at most 0.5 mm. In a further advantageous embodiment of the lamp according to the invention, the cermet has a tapering shape adjacent the end and is provided with a narrowed portion. This renders it possible to have the cermet extend to outside the projecting plug with its narrowed portion, while retaining the favorable properties of the sintered joint of limited length. A cermet extending to outside the projecting plug is advantageous for an efficient large-scale mass production of lamps, because a simpler fastening of the electrical conductor is possible, whereby the risk of production wastage is further reduced.

The invention is favorable in particular for lamps having a comparatively high power rating, for example of 100 W or more.

BRIEF DESCRIPTION OF THE DRAWING

The above and further aspects of the invention will be explained in more detail with reference to a drawing, in which.

DESCRIPTION OF THE PREFERRED EMBODIMENTS

Figure 1:
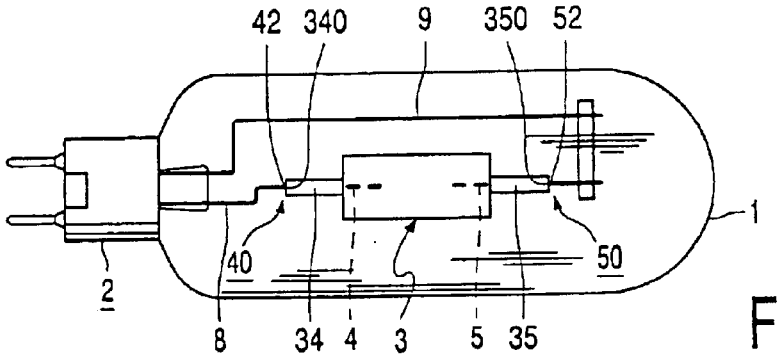
FIG. 1 diagrammatically shows a lamp according to the invention.
Figure 2:
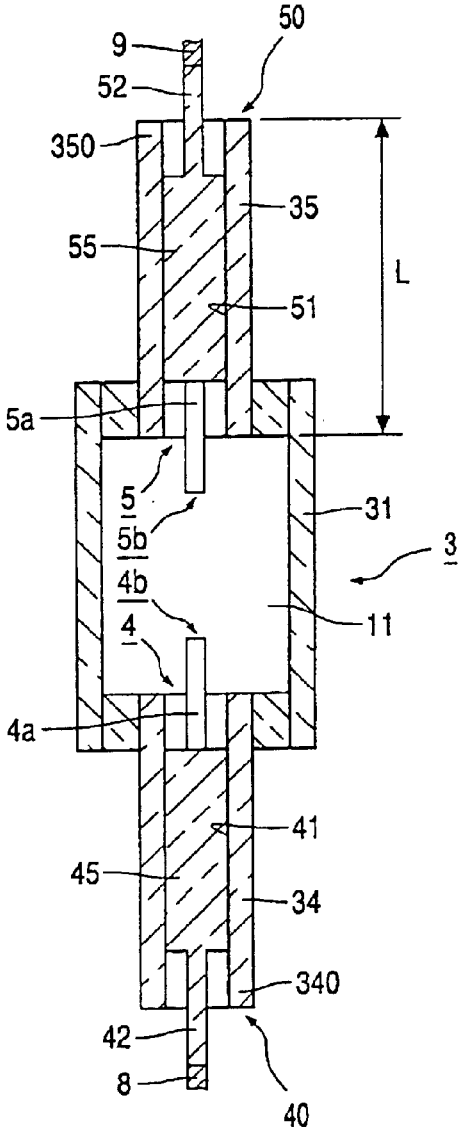
FIG. 2 shows the discharge vessel of the lamp of FIG. 1.

FIG. 1 shows a high-pressure discharge lamp provided with a discharge vessel 3 with a ceramic wall which is closed off at an end by means of a projecting plug 34, 35 through which a lead-through construction 40, 50 extends from an end 340, 350 of the projecting plug to an electrode 4, 5 positioned in the discharge vessel, part of said lead-through construction being a cermet 45, 55 (FIG. 2). The projecting plug also has a ceramic wall. In a practical embodiment of the lamp, the discharge vessel contains at least one metal halide in addition to Hg and a rare gas.

The discharge vessel is surrounded by an outer envelope 1 which is provided with a lamp cap 2 at an end. In the operational state of the lamp, a discharge extends between the electrodes 4 and 5. The electrode 4 is connected to a first electrical contact point forming part of the lamp cap 2 via a current conductor 8. Similarly, the electrode 5 is connected to a second electrical contact point of the lamp cap 2 via a current conductor 9.

The discharge vessel, which is depicted not true to scale in FIG. 2, has a ceramic wall 31 and encloses a discharge space 11. The wall 31 is cylindrical and is closed at either end by the respective ceramic projecting plug 34, 35 which is connected to the wall 31 in a gastight manner by means of a sintered joint. The lead-through construction is formed by the cermet 45, 55 and the sintered joint 41, 51, by means of which the cermet is directly fastened to the projecting plug 34, 35. The electrode 4, 5, made of W in the drawing, is fastened to an electrode rod 4*a*, 5*a* at the end of the cermet 45, 55 facing towards the discharge space. The electrode is provided with an electrode tip 4*b*, 5*b* to which the discharge applies itself when the lamp is in the operational state.

The projecting plug extends over a length L. The sintered joint 41 , 51 of the cermet 45, 55 has a length of at most 0.8L and extends into the projecting plug in a direction from the end 340, 350 up to a distance of at most 0.5 mm from the end. In the embodiment shown, the cermet is narrowed adjacent the end and provided with a narrowed portion 42, 52 which extends to outside the projecting plug 34, 35. The electrical conductor 8, 9 is fastened to the narrowed portion of the cermet in a manner known per se.

In a practical realization of the lamp described, the lamp has a power rating of 150 W. The discharge vessel has a filling consisting of 0.6 mg of Hg, 1.5 mg of iodides of Na, Ce, and Li, and Ar with a filling pressure of 25 kPa. The discharge vessel and the projecting plugs each have a ceramic wall made of translucent densely sintered $Al_2O_3$. Each projecting plug has a length of 9 mm. The cermets of the lead-through constructions are made of $Al_2O_3$ (70% by volume) and Mo (30% by volume), have a length of 13 mm each, and are connected to the relevant projecting plug by means of a sintered joint of 7 mm in length. The sintered joints extend to 1 mm from the adjacent end of the relevant projecting plug. The cermets are narrowed adjacent the end of the relevant projecting plug and provided with a narrowed portion having a length of 6 mm and extending to outside the projecting plug.

During lamp manufacture, a sintered joint was created between the cermets and the projecting plugs in a sintering process in which the projecting plug with the cermet provided were fired for 2 hours in a hydrogen atmosphere at a temperature of 1450 K. A hermetically sealed closure was formed thereby.

The scope of protection of the invention is not limited to the embodiments given by way of example here. The invention is defined by each novel characteristic and all combinations of characteristics. Reference numerals in the claims do not limit the scope of protection thereof. The use of forms of the verb "comprise" does not exclude the presence of elements other than those mentioned in the claims. The use of the indefinite article "a" and "an" preceding an element does not exclude the possibility of a plurality of such elements being present.

What is claimed is:

1. A high-pressure discharge lamp provided with a discharge vessel with a ceramic wall which is closed at an end by a projecting plug through which a lead-through construction extends from an end of the projecting plug to an electrode arranged in the discharge vessel, part of said lead-through construction being a cermet, the cermet being directly fastened to the projecting plug by means of a sintered joint, characterized in that the projecting plug extends over a length L, and the sintered joint has a length of at most 0.8 L.

2. A high-pressure discharge lamp as claimed in claim 1, characterized in that the sintered joint extends into the projecting plug in a direction from the end to a distance away from the end of at most 0.5 mm.

3. A high-pressure discharge lamp as claimed in claim 1, characterized in that the cermet has a tapering shape adjacent the end and is provided with a narrowed portion.

4. A high-pressure discharge lamp as claimed in claim 1, characterized in that the lamp is a metal halide lamp.

5. A high-pressure discharge lamp as claimed in claim 1, characterized in that the lamp has a power rating of at least 100 w.

6. A high-pressure discharge lamp as claimed in claim 1, wherein the projecting plug is made impermeable to light over at least a part of its outer side.

7. A high pressure discharge lamp provided with a discharge vessel with a ceramic wall which is closed at an end by a projecting plug through which a lead-through construction extends from an end of the projecting plug to an electrode arranged in the discharge vessel, part of said lead-through construction being a cermet, the cermet being directly fastened to the projecting plug by means of a sintered joint, characterized in that the cermet has the approximate composition of 70% by volume $Al_2O_3$ and 30% by volume Mo.

8. A high-pressure discharge lamp as claimed in claim 7, wherein the projecting plug is made impermeable to light over at least a part of its outer side.

* * * * *